US007950105B2

(12) United States Patent
Elsworthy

(10) Patent No.: US 7,950,105 B2
(45) Date of Patent: May 31, 2011

(54) CLEANING APPARATUS WITH MOTORISED ENDLESS BELT

(75) Inventor: Christopher Thomas Elsworthy, Bristol (GB)

(73) Assignee: C Enterprise (HK) Limited, Kowloon (HK)

( * ) Notice: Subject to any disclaimer, the term of this patent is extended or adjusted under 35 U.S.C. 154(b) by 1026 days.

(21) Appl. No.: 11/753,816

(22) Filed: May 25, 2007

(65) Prior Publication Data

US 2008/0289142 A1 Nov. 27, 2008

(51) Int. Cl.
*A47L 5/00* (2006.01)

(52) U.S. Cl. ..... 15/391; 15/99; 15/51

(58) Field of Classification Search ..... 15/51, 99; *A47L 11/03, 11/292*
See application file for complete search history.

(56) References Cited

U.S. PATENT DOCUMENTS

| | | | | |
|---|---|---|---|---|
| 2,268,073 | A * | 12/1941 | Harold J et al. | 15/99 |
| 2,930,057 | A | 3/1960 | Evans | |
| 3,047,894 | A | 8/1962 | Sprang | |
| 3,945,078 | A * | 3/1976 | Acquaro | 15/99 |
| 4,926,515 | A * | 5/1990 | Lynn et al. | 15/4 |
| 5,933,900 | A * | 8/1999 | Wang | 15/50.3 |
| 6,145,145 | A | 11/2000 | Besel | |
| 2006/0010626 | A1 * | 1/2006 | Sjoberg | 15/99 |

FOREIGN PATENT DOCUMENTS

| | | |
|---|---|---|
| DE | 35 19 742 A1 | 1/1987 |
| DE | 100 20 197 A1 | 11/2001 |
| FR | 1 009 211 | 5/1952 |
| FR | 2836 363 A1 | 8/2003 |

* cited by examiner

*Primary Examiner* — Monica S Carter
*Assistant Examiner* — Stephanie Newton
(74) *Attorney, Agent, or Firm* — Leydig, Voit & Mayer, Ltd.

(57) ABSTRACT

A motor-driven endless absorbent belt on an apparatus may be used for scrubbing or polishing surfaces, or removing liquid from surfaces. The belt is located about a cleaning head demountable from a housing for replacement of the belt, a roller mounted to the head and cooperating with a roller mounted to the housing to squeeze liquid and contaminants from the belt into a first reservoir in the housing. A driven roller mounted on the removable cleaning head preferably encloses a rotary motor, the belt being pinched between the driven roller and the housing-mounted roller.

46 Claims, 5 Drawing Sheets

CLEANING APPARATUS WITH MOTORISED ENDLESS BELT

TECHNICAL FIELD

The present invention relates to a cleaning device and, more particularly, a motorised endless belt cleaning device which is able to remove fluids and other contaminants from a surface to be cleaned, such as a floor.

BACKGROUND OF THE INVENTION

A typical mop includes a head attached to the end of a handle together with a squeezing mechanism that is used in conjunction with a water bucket to assist in squeezing dirty water out of the mop head. The problem with this prior art cleaning technology and method is that the mop head is rinsed in dirty water, requiring the water in the bucket to be changed frequently and thus making inefficient use of both water and detergent. In addition, prior art systems often leave the cleaned surface wet for a period of time which is longer than desired.

Cleaning apparatus that address these problems may incorporate the use of electric motors to power components such as rotating cleaning members (for instance brushes or pads) which are trailed by vacuum suction devices that provide means for picking up dirty water which has been produced by the rotating brushes scrubbing up dirt with the water provided by the machine. To achieve reasonable versatility from such machines, it is desirable the cleaning members can be interchanged readily, depending for example upon whether it is desired to use the machine for scrubbing, polishing or drying a surface.

U.S. Pat. No. 3,945,078 describes a machine with an open bottom from which a lower run of an endless fabric belt projects downwardly, this belt passing around a large drive roller and several idler rollers. One of the idler rollers is spring-loaded for tensioning the belt and mounted in a reservoir for water or other liquid into which the upper run of the belt dips before passing through a wringer constituted by a further roller pair. The drive roller is hollow and driven by a motor supported in its interior by an axle traversing one of the end faces of that roller. Drawbacks of this machine include the difficulty in replacing the belt, and in particular the necessity to release the spring-loaded tensioning roller when replacing the belt A large number of rollers are required, increasing manufacturing costs. Furthermore, the dirty liquid wrung from the belt back drains into the reservoir of rinsing water, and due to the lower run of the belt supporting the machine, the machine must be inverted to examine the condition of the belt. It is an object of the present invention to overcome or substantially ameliorate the above disadvantages or more generally to provide an improved cleaning apparatus.

DISCLOSURE OF THE INVENTION

According to one aspect of the present invention there is provided a cleaning apparatus for cleaning a surface, comprising:

a housing holding a first reservoir;

a housing-mounted roller mounted to the housing;

a cleaning head releasably coupled to the housing;

a plurality of head-mounted rollers mounted to the cleaning head;

drive means operatively connected to at least a driven one of the rollers for rotation thereof, and an endless absorbent belt supported for rotation about the head-mounted rollers;

whereby in an operating position the belt is pinched between the housing-mounted roller and one of the head-mounted rollers to squeeze liquid and contaminants from the belt into the first reservoir, and the cleaning head is movable relative to the housing from the operating position to a released position in which the belt is released from between the housing-mounted roller and the one of the head-mounted rollers to remove the belt.

It will be understood that the belt may be pinched between more than one housing-mounted roller and head-mounted roller pair. Also, the belt may be pinched at two or more angular positions on a housing-mounted roller by respective head-mounted rollers, or vice versa at two or more angular positions on a head-mounted roller by respective housing-mounted rollers.

Preferably in the operating position the housing-mounted roller deflects the belt from a line tangentially connecting the periphery of two adjacent head-mounted rollers to tension the belt. Preferably each of the head-mounted rollers engages an inner face of the belt. Optionally at least one head-mounted roller may engage an outer face of the belt.

The drive means preferably comprises a rotary motor mounted to the cleaning head for rotating a driven one of the head-mounted rollers. Alternatively the drive means may include a surface-engaging wheel rotated by movement of the apparatus. In the operating position the belt is preferably squeezed between the housing-mounted roller and the driven head-mounted roller. Preferably the rotary motor is mounted within the driven head-mounted roller.

The housing and the cleaning head preferably further include electrical couplings connected in the operating position to supply power to the motor and separated in the released position.

Preferably the operating position the housing-mounted roller deflects the belt from a line tangentially connecting the periphery of two adjacent head-mounted rollers to tension the belt. Each of the head-mounted rollers preferably engages an inner face of the belt.

Preferably the cleaning head is demountably coupled to the housing by cooperating manually releasable connectors on the cleaning head and housing, allowing the cleaning head to be separated from the housing without the use of tools for the removal or replacement of the belt. Optionally, an element such as a hinge may connect the cleaning head and housing in a manner allowing sufficient relative movement from the operating position for removal or fitting of the belt.

The apparatus preferably further includes synchronising means for synchronising the peripheral speeds the housing-mounted roller and one of the head-mounted rollers between which the belt is squeezed in the operating position.

Preferably the synchronising means comprises a meshed gear pair, each gear rotationally fast with a respective one of the rollers.

Preferably the apparatus further includes at least one wheel fixed to the housing for supporting the apparatus upon the surface, the head-mounted rollers include first and second head-mounted rollers, with a lower run of the belt for engaging the surface supported therebetween.

Preferably the cleaning head is mounted to and projects from a forward end of the housing, an upper run of the belt extends acutely to the lower run and is supported between the drive roller and a forwardmost one of the first and second head-mounted rollers.

The apparatus preferably further includes a second reservoir, a nozzle for receiving liquid from the second reservoir and spraying the liquid over the upper run and flow control means for controlling the flow of liquid to the nozzle. The flow control means may be a valve or a pump.

The apparatus preferably further includes a handle connected to the housing to pivot about a first axis generally parallel to roller axes, and about a second axis generally perpendicular to the first axis for allowing the apparatus to be steered. The second reservoir, nozzle and flow control means are preferably fixed to the handle.

Switch means are preferably mounted on the end of the handle for operating the motor and the flow control means. Preferably a trigger is provided for operating the flow control means and a switch for operating the motor. Optionally, the trigger may have a two-stage operation such that initial depression of the trigger operates the motor and further depression of the trigger operates the flow control means.

According to an alternative embodiment of the present invention there is provided a cleaning apparatus for cleaning a surface, comprising:

a housing;

a housing-mounted roller mounted to the housing;

a cleaning head releasably coupled to the housing;

a plurality of head-mounted rollers mounted to the cleaning head;

drive means operatively connected to at least a driven one of the rollers for rotation, thereof, and an endless belt supported for rotation about the head-mounted rollers;

whereby in an operating position the housing-mounted roller deflects the belt from a line tangentially connecting the periphery of two adjacent head-mounted rollers to tension the belt and the cleaning head is movable relative to the housing from the operating position to a released position in which the belt tension is released to remove the belt.

In this alternative embodiment it will be understood that the belt may be tensioned by cooperation between more than one housing-mounted roller and the two adjacent head-mounted rollers. This alternative embodiment may be used, for example, for polishing a floor

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
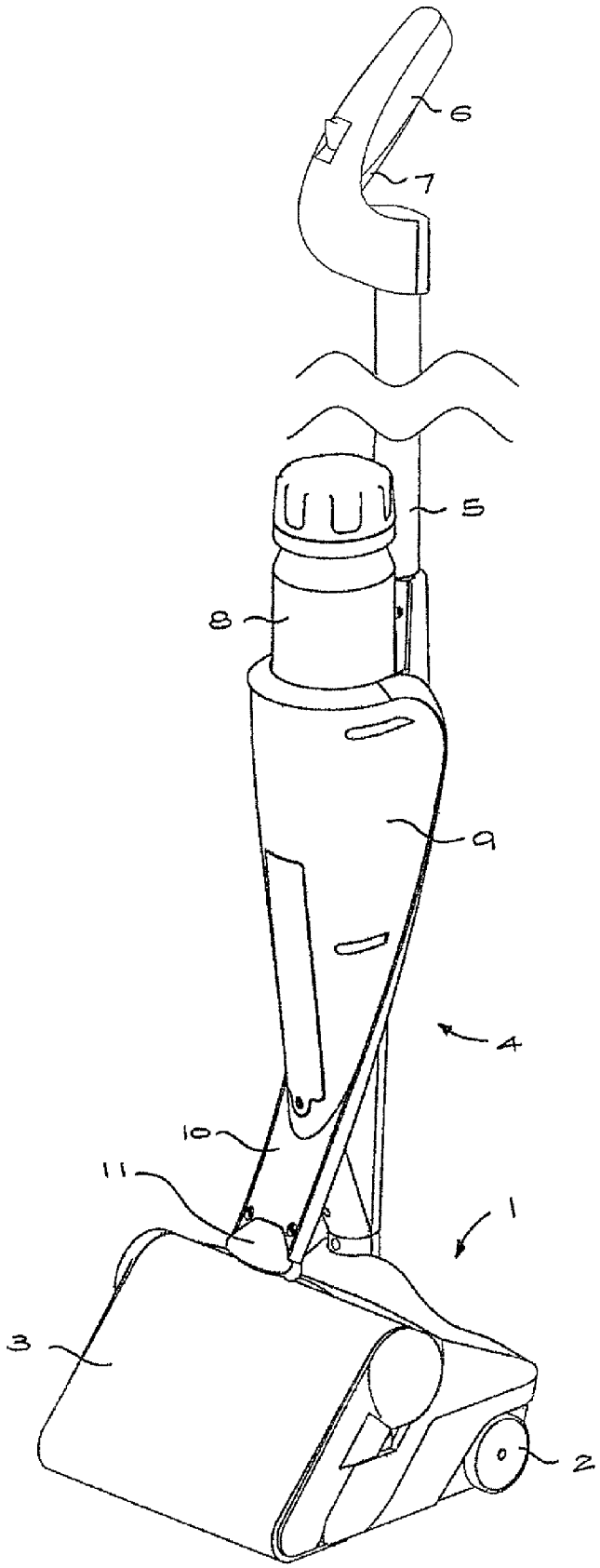
FIG. 1 is a pictorial view of an embodiment of the surface cleaning apparatus of the invention.

A preferred embodiment of the invention for cleaning floors is illustrated in the drawings, but it will be appreciated that it may be used for cleaning other surfaces such as walls or ceilings with appropriate modification. Referring to FIG. 1, the cleaning apparatus includes a base 1 supported at the rear by wheels 2 on either side thereof and the front by an endless absorbent belt 3. Pivotally connected to the base 1 is a handle assembly 4 including an elongate shaft 5 extending to a handgrip 6. Adjacent the handgrip 6 is a trigger 7. The handle assembly 4 further includes a washing liquid reservoir 8 and a battery enclosure 9. A conduit 10 leads downward from the enclosure 9 to a nozzle 11 located above the belt 3.

Figure 2:
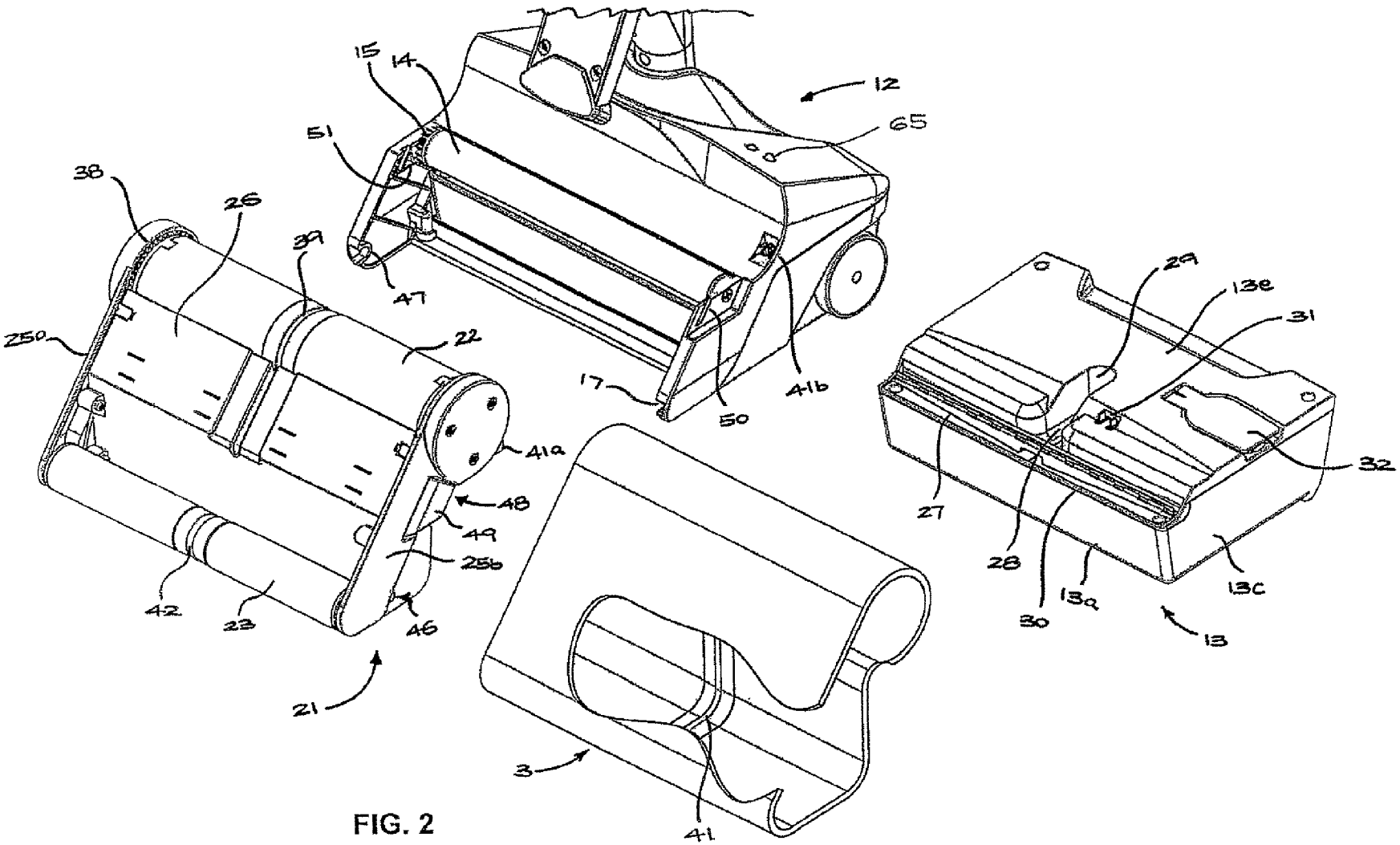
FIG. 2 is a pictorial view of the apparatus of FIG. 1 disassembled.
Figure 3:
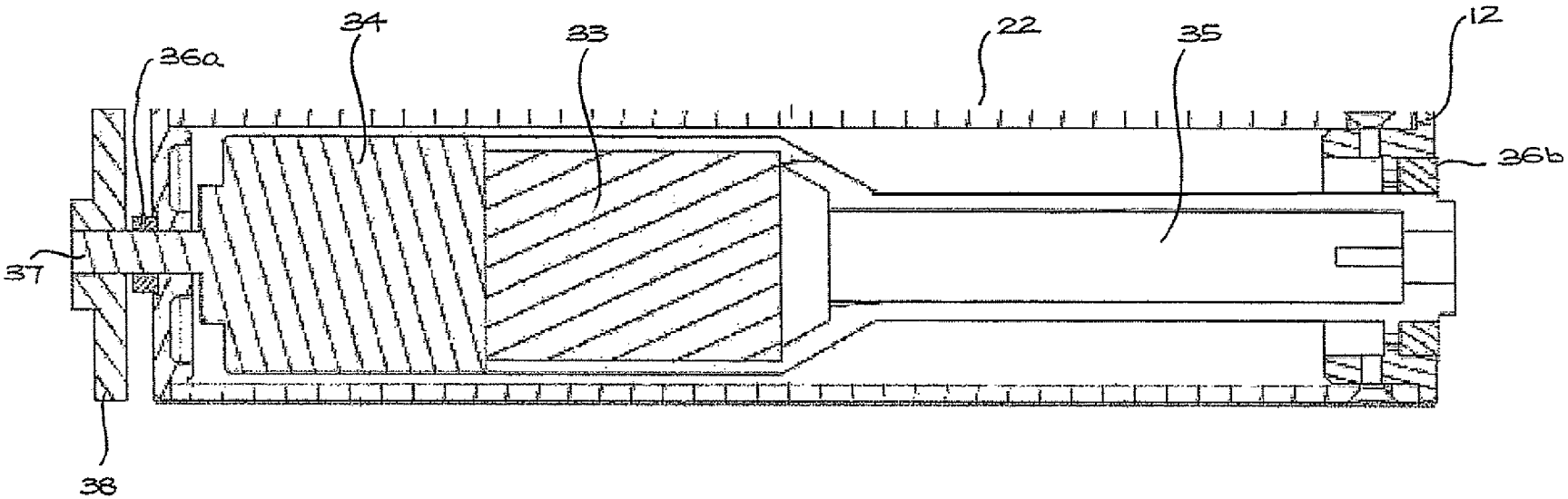
FIG. 3 is a cross section on a plane intersecting a central axis of the driven roller of the apparatus of FIG. 1.
Figure 4:
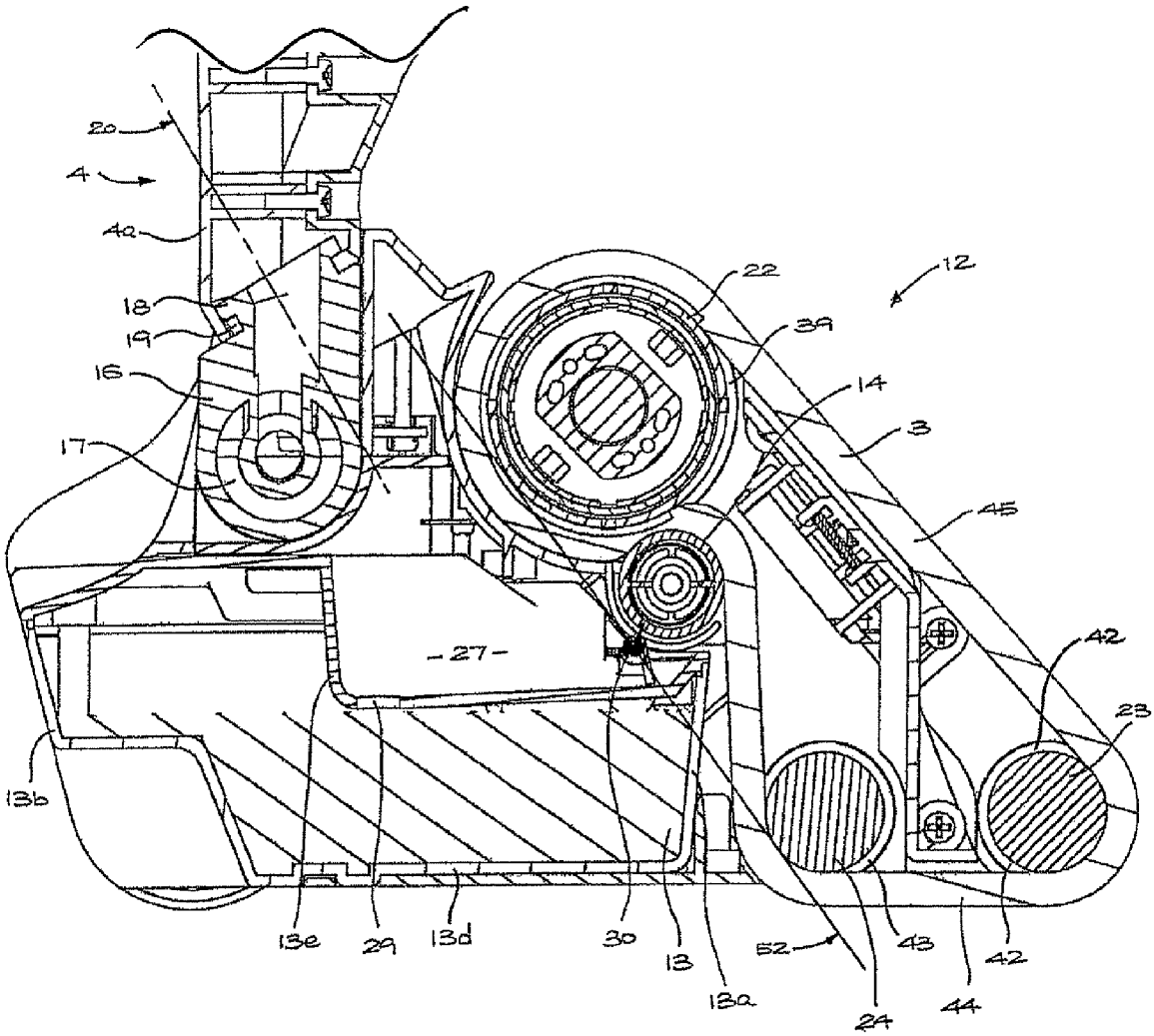
FIG. 4 is a cross section on an upright central plane of the base of the apparatus of FIG. 1.

As seen in FIGS. 2-4 the base 1 includes a housing 12 having a cavity 27 in which a contaminated liquid reservoir 13 is received. An elongate housing-mounted wringer roller 14 is mounted to the housing 12 above the contaminated liquid reservoir 13, extending transversely and supported for rotation at both ends. A driven gear 15 is rotationally fast with the wringer roller 14 at one end thereof.

The handle assembly 4 includes a handle body 4*a* connected by an articulated joint 16 at its lower end to the housing 12. The joint 16 is connected at its proximal end by transversely-aligned pivot 17 to a central part of the housing 12. At the distal end of the joint 16 is a circular collar 18 that engages a ring portion 19 formed on the handle body 4*a* allowing the handle body 4*a* to pivot relative thereto about the common axis 20 of the collar 18 and ring 19. This axis 20 is perpendicular to the transverse axis of the pivot 17 for allowing the base 1 to be steered.

The cavity 27 opens rearwardly between the wheels 2, the contaminated liquid reservoir 13 is slidably received therein allowing it to be removed for emptying. The contaminated liquid reservoir 13 includes transparent front and rear walls 13*a*, 13*b*, side walls 13*c*, base wall 13*d* and top wall 13*e*. A channel 27 extends substantially along the width of the top wall 13*e* and drains, via a central portion 28, to an inlet aperture 29 leading into the reservoir 13. An elongate resilient wiper 30 is mounted to the reservoir 13 and engages the length of the wringer roller 14. The contaminated liquid reservoir 13 further includes an electrical coupling 31 connected to a liquid level sensor (not shown) for actuating a level warning indicator lamp 65 mounted to the top of the housing 12. A closure 32 closes an outlet for emptying the reservoir.

A cleaning head 21 is releasably mounted to the front of the housing 12 and includes three elongate and substantially parallel cylindrical head-mounted rollers comprising: drive roller 22, front roller 23 and rear roller 24. The head-mounted rollers 22-24 are supported for rotation at opposing ends in journals (not shown) fixed in the opposing end plates 25*a*, 25*b* which are joined by member 26.

The drive roller 22 encloses a rotary electric motor 33 drivingly connected to a reduction gearbox 34 and to a torque rod 35 which is in turn fixed to the end plate 25*b* of the head 21 to prevent rotation of the motor and gear box 34. Opposing ends of the drive roller 22 are supported in bearings 36*a*, 36*b*. A gearbox output shaft 37 is rotationally fast with the driven roller 22 and with a drive gear 38, which in use engages the driven gear 15 for synchronising the peripheral speeds of the driven head roller 22 and the wringer roller 14. Electrical coupling parts 41*a* and 41*b* are fixed to the end plate 25*b* of cleaning head 21 and housing 12 respectively for supplying power to the motor 33, when the head 21 is connected. A guide channel 39 in a central part of the driven roller 22 extends circumferentially below its substantially cylindrical outer surface and receives a rib 41 which extends continuously around an inner face of the belt 3.

Both front roller 23 and rear roller 24 also have respective guide channels 42, 43 aligned with the guide channel 39 for cooperating with the circumferential rib 41 to retain the belt 3 in its correct transverse position in use. A lower run 44 of the belt 3 is supported between the front roller 23 and rear roller 24 at the front of the apparatus and provides the primary area for contacting the surface to be cleaned. An exposed upper run 45 of the belt 3 extends acutely to the lower run 44 and is supported between the drive roller 22 and front roller 23.

Fixed on each of the end plates 25*a*, 25*b* are nubs 46 which are received in respective recesses 47 in the housing 12 and which cooperate with a manually releasable connector 48 on the head 21 for fastening the head 21 to the housing 12. The connector 48 includes a lever 49 pivotally mounted to the end plate 25*b* and having a tongue (not shown) and spring (not shown) which biases the lever 49 such that the tongue is received in the aperture 50 in the housing 12. A cooperating lock member (not shown) is mounted to the opposing end plate 25*a*, and has a respective tongue biased to engage in the opposing aperture 51. A rod (not shown) extends between the lever 49 and lock member for releasing both connectors simultaneously.

In use the belt 3 may be changed when worn, or to provide a belt for a particular operation such as coarse scrubbing, fine polishing or absorbing liquid. The belt 3 is inserted over the cleaning head 21 with the channels 39, 42, 43 receiving the circumferential rib 41. The head 21 and belt 3 are then connected to the housing 12 by the cooperating nubs 46 and recesses 47, and the connector 48. In this operating position (shown in FIGS. 1 and 4) the belt 3 is pinched between the wringer roller 14 and the drive roller 22 to squeeze liquid and contaminants from the belt 3 into the reservoir 13. This pinching action also provides good traction for rotating the belt. The wringer roller 14 deflects the belt 3 inwardly from the line 52 tangentially connecting the periphery of the adjacent drive roller 22 and rear roller 24 to tension the belt 3, thereby avoiding the need for a separate tensioning device.

Figure 5:
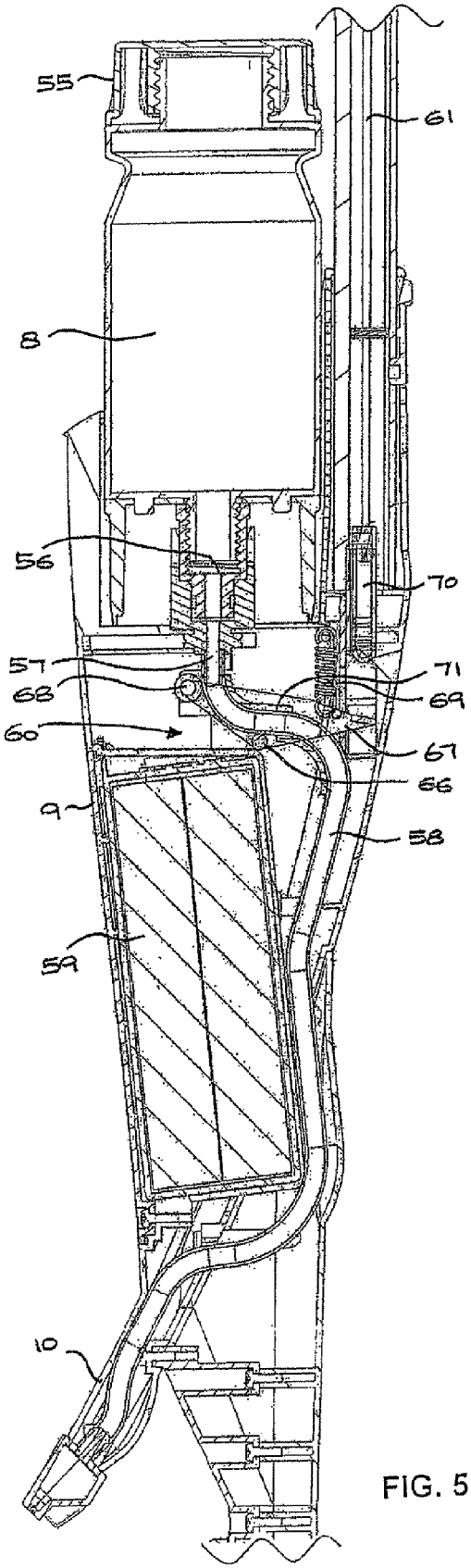
FIG. 5 is a cross section on an upright central plane of the handle assembly of the apparatus of FIG. 1.
Figure 6:
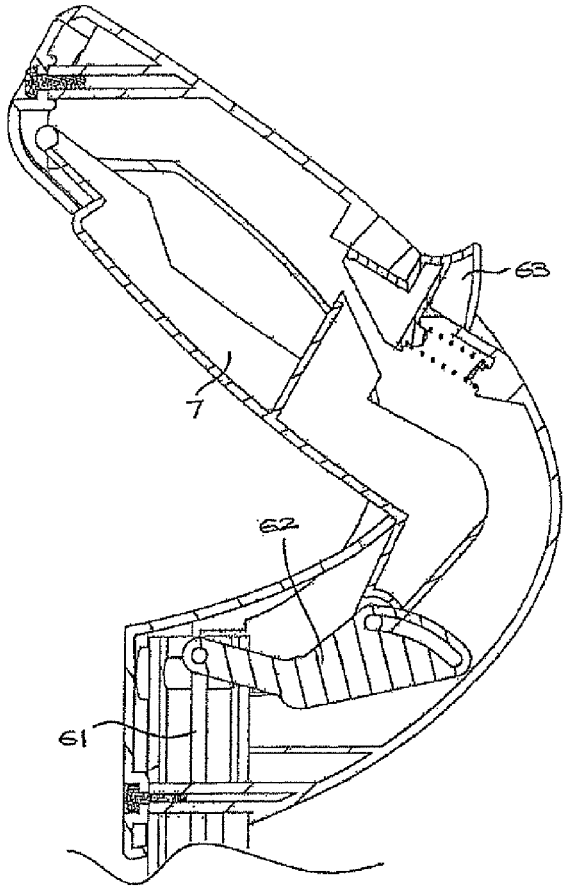
FIG. 6 is a cross section on an upright central plane of the handgrip of the apparatus of FIG. 1.

Referring to FIGS. 5 and 6 the washing liquid reservoir 8 is demountable from the handle assembly 4 and includes a closure 55 at its upper end and a self-closing reservoir valve 56 at its lower end, allowing the reservoir 8 to be removed for filling with water and/or detergent. The reservoir valve 56 is opened by a stem 57 which communicates with a flexible and resilient tube 58 which extends down behind the batteries 59 and through the conduit 10 to the nozzle 11. The liquid flow from the nozzle 11 is controlled by a valve 60 operated through a rod 61 connected to the trigger 7. The valve 60 includes a pinch block 66 abutting the outer wall of the tube 58 fixed to a mount 67 that is connected by a pivot 68 to the inner wall of the enclosure 9. A tension spring 69 connected between the mount 67 and the enclosure 9 tends to rotate the mount 67 to close the valve, pinching the tube 58 between the block 66 and the fixture 71. The valve 60 is held open by a slider 70 which engages the mount 67. The slider 70 is connected to one end of the rod 61. The pivotally-mounted trigger 7 is connected via a rocker 62 to the rod 61, allowing the trigger 7 to be pulled to open the valve 60. The handgrip 6 further includes a switch 63 for controlling operation of the motor 33.

In use the trigger is operated with the handle assembly 4 upright as shown in FIG. 2 to apply a spray evenly across the width of the upper run 45. Optionally, by rotating the handle assembly 4 about the axis 20 with the handle assembly upright the cleaning liquid may be applied preferentially to one or other side of the belt 3. In use, the handle assembly is inclined from the upright and in this position operating the trigger directs a spray onto the surface to be cleaned, as desired.

Aspects of the present invention have been described by way of example only and it should be appreciated that modifications and additions may be made thereto without departing from the scope thereof.

The invention claimed is:

1. A cleaning apparatus for cleaning a surface, comprising:
a housing holding a first reservoir;
a housing-mounted roller mounted on the housing;
a cleaning head releasably coupled to the housing;
a plurality of head-mounted rollers mounted on the cleaning head;
drive means operatively connected to a driven head-mounted roller, which is one of the head-mounted rollers, for rotation of the driven head-mounted roller, and
an endless absorbent belt supported for rotation about the head-mounted rollers, wherein,
when the belt is in an operating position,
the belt is pinched between the housing-mounted roller and the driven head-mounted roller, thereby squeezing liquid and contaminants from the belt into the first reservoir, and
the housing-mounted roller deflects the belt from a line that is tangent to both of the driven head-mounted roller and another of the head-mounted rollers, thereby tensioning the belt, and
the cleaning head is movable relative to the housing between the operating position of the belt and a released position of the belt, in which the belt is released from between the housing-mounted roller and the driven head-mounted for removal of the belt from the cleaning head.

2. The apparatus of claim 1 wherein the drive means comprises a rotary motor mounted on the cleaning head and within the driven head-mounted roller for rotating the driven head-mounted roller.

3. The apparatus of claim 1 wherein the housing and the cleaning head include electrical couplings that are connected to each other in the operating position of the belt to supply power to the motor, and that are separated from each other in the released position of the belt.

4. The apparatus of claim 2 wherein the first reservoir is received within the housing and, when the cleaning apparatus is in an upright position, the housing-mounted roller is disposed above the first reservoir and the driven head-mounted roller is disposed above the housing-mounted roller.

5. The apparatus of claim 1 wherein each of the head-mounted rollers engages an inner face of the belt.

6. The apparatus of claim 1 wherein each of the head-mounted rollers engages an inner face of the belt.

7. The apparatus of claim 1 wherein the cleaning head is demountably coupled to the housing by cooperating manually releasable connectors on the cleaning head and the housing.

8. The apparatus of claim 6 wherein the cleaning head is demountably coupled to the housing by cooperating manually releasable connectors on the cleaning head and the housing.

9. The apparatus of claim 1 including synchronising means for synchronising peripheral speeds of the housing-mounted roller and the driven head-mounted roller between which the belt is pinched in the operating position of the belt.

10. The apparatus of claim 8 further including synchronising means for synchronising peripheral speeds of the housing-mounted roller and the driven head-mounted roller between which the belt is pinched in the operating position of the belt.

11. The apparatus of claim 9 wherein the synchronising means comprises a pair of meshed gears, each gear of the pair of gears being rotationally fixed to a respective one of the head-mounted rollers.

12. The apparatus of claim 10 wherein the synchronising means comprises a pair of meshed gears, each gear of the pair of gears being rotationally fixed to a respective one of the head-mounted rollers.

13. The apparatus of claim 1 wherein the apparatus includes at least one wheel fixed to the housing for supporting the apparatus upon the surface, and the head-mounted rollers include first and second head-mounted rollers so that a lower run of the belt for engaging the surface is supported between the first and second head-mounted rollers.

14. The apparatus of claim 2 wherein the apparatus includes at least one wheel fixed to the housing for supporting the apparatus upon the surface, and the head-mounted rollers include first and second head-mounted rollers so that a lower run of the belt for engaging the surface is supported between the first and second head-mounted rollers.

15. The apparatus of claim 13 wherein the cleaning head is mounted on and projects from a forward end of the housing, and an upper run of the belt extends to the lower run and is supported between the driven head-mounted roller and a forwardmost one of the first and second head-mounted rollers.

16. The apparatus of claim 14 wherein the cleaning head is mounted to and projects from a forward end of the housing, and an upper run of the belt extends to the lower run and is supported between the driven head-mounted roller and a forwardmost one of the first and second head-mounted rollers.

17. The apparatus of claim 1 including a second reservoir, a nozzle for receiving liquid from the second reservoir and spraying the liquid over an upper run of the belt, and flow control means for controlling flow of liquid to the nozzle.

18. The apparatus of claim 2 including a second reservoir, a nozzle for receiving liquid from the second reservoir and spraying the liquid over an upper run of the belt, and flow control means for controlling flow of liquid to the nozzle.

19. The apparatus of claim 17 further including a handle connected to the housing and pivoting about a first axis generally parallel to roller axes, and about a second axis generally perpendicular to the first axis for steering the apparatus.

20. The apparatus of claim 19 wherein the second reservoir, nozzle, and flow control means are fixed to the handle.

21. The apparatus of claim 1 wherein the belt includes a rib or groove on an inner face of the belt for locating the belt transversely on the head-mounted rollers, and at least one of the head-mounted rollers has a complementary groove or rib for engagement with the rib or groove of the belt.

22. The apparatus of claim 2 wherein the belt includes a rib or groove on an inner face of the belt for locating the belt transversely on the head-mounted rollers, and at least one of the head-mounted rollers has a complementary groove or rib for engagement with the rib or groove of the belt.

23. A cleaning apparatus for cleaning a surface, comprising:

a housing;

a housing-mounted roller mounted on the housing;

a cleaning head releasably coupled to the housing;

a plurality of head-mounted rollers mounted on the cleaning head;

a rotary motor mounted on the cleaning head and operatively connected to head-mounted roller, which is one of the head-mounted rollers, for rotation of the driven head-mounted roller, and an endless belt supported for rotation about the head-mounted rollers, wherein, in an operating position of the belt, the housing-mounted roller deflects the belt from a line tangent to the driven head-mounted roller and another of the head-mounted rollers, thereby tensioning the belt, and the belt is pinched between the housing-mounted roller and the driven head-mounted roller, and the cleaning head is movable relative to the housing from the operating position of the belt to a released position of the belt, in which the belt tension is released for removal of the belt from the cleaning head.

24. The apparatus of claim 23 wherein the rotary motor is mounted within the driven head-mounted roller.

25. The apparatus of claim 23 wherein the housing and the cleaning head include electrical couplings that are connected in the operating position of the belt to supply power to the motor, and that are separated in the released position of the belt.

26. The apparatus of claim 24 wherein the housing and the cleaning header include electrical couplings that are connected in the operating position of the belt to supply power to the motor, and that are separated in the released position of the belt.

27. The apparatus of claim 23 wherein each of the head-mounted rollers engages an inner face of the belt.

28. The apparatus of claim 26 wherein each of the head-mounted rollers engages an inner face of the belt.

29. The apparatus of claim 23 wherein the cleaning head is demountably coupled to the housing by cooperating manually releasable connectors on the cleaning head and the housing.

30. The apparatus of claim 28 wherein the cleaning head is demountably coupled to the housing by cooperating manually releasable connectors on the cleaning head and the housing.

31. The apparatus of claim 23 including synchronising means for synchronising peripheral speeds of the housing-mounted roller and the driven head-mounted roller between which the belt is pinched in the operating position of the belt.

32. The apparatus of claim 24 including synchronising means for synchronising peripheral speeds of the housing-mounted roller and the head-mounted roller between which the belt is squeezed in the operating position of the belt.

33. The apparatus of claim 31 wherein the synchronising means comprises a pair of meshed gears, each gear of the pair of gears being rotationally fixed to a respective one of the head-mounted rollers.

34. The apparatus of claim 24 wherein the synchronising means comprises a pair of meshed gears, each gear of the pair of gears being rotationally fixed to a respective one of the head-mounted rollers.

35. The apparatus of claim 23 wherein the apparatus includes at least one wheel fixed to the housing for supporting the apparatus upon the surface, and the head-mounted rollers include first and second head-mounted rollers so that a lower run of the belt for engaging the surface is supported between the first and second head-mounted rollers.

36. The apparatus of claim 24 wherein the apparatus includes at least one wheel fixed to the housing for supporting the apparatus upon the surface, and the head-mounted rollers include first and second head-mounted rollers so that a lower run of the belt for engaging the surface is supported between the first and second head-mounted rollers.

37. The apparatus of claim 35 wherein the cleaning head is mounted on and projects from a forward end of the housing, and an upper run of the belt extends to the lower run and is supported between the driven head-mounted roller and a forwardmost one of the first and second head-mounted rollers.

38. The apparatus of claim 36 wherein the cleaning head is mounted on and projects from a forward end of the housing, and an upper run of the belt extends to the lower run and is supported between the driven head-mounted roller and a forwardmost one of the first and second head-mounted rollers.

39. The apparatus of claim 23 including a reservoir, a nozzle for receiving liquid from the reservoir and spraying the liquid over an upper run of the belt, and flow control means for controlling flow of liquid to the nozzle.

40. The apparatus of claim 24 including a reservoir, a nozzle for receiving liquid from the reservoir and spraying the liquid over an upper run of the belt, and flow control means for controlling flow of liquid to the nozzle.

41. The apparatus of claim 39 including a handle connected to the housing and pivoting about a first axis generally parallel to roller axes, and about a second axis generally perpendicular to the first axis for steering the apparatus.

42. The apparatus of claim 41 wherein the reservoir, nozzle, and flow control means are fixed to the handle.

43. The apparatus of claim 23 wherein the belt includes a rib or groove on an inner face of the belt, for locating the belt transversely on the head-mounted rollers, and at least one of the rollers has a complementary groove or rib for engagement with the rib or groove of the belt.

44. The apparatus of claim 24 wherein the belt includes a rib or groove on an inner face of the belt, for locating the belt transversely on the head-mounted rollers, and at least one of the rollers has a complementary groove or rib for engagement with the rib or groove of the belt.

45. The apparatus of claim 4 wherein the housing and the cleaning head include electrical couplings that are connected in the operating position of the belt to supply power to the motor, and that are separated from each other in the released position of the belt.

46. The apparatus of claim 23 including a reservoir held by the housing, wherein the rotary motor is mounted within the driven head-mounted roller, and, when the cleaning apparatus is in an upright position, the housing-mounted roller is disposed above the reservoir and the driven head-mounted roller is disposed above the housing-mounted roller.

* * * * *